US010199015B2

(12) United States Patent
Tsuruta

(10) Patent No.: US 10,199,015 B2
(45) Date of Patent: Feb. 5, 2019

(54) STRINGED INSTRUMENT

(71) Applicant: Souichi Tsuruta, Hekinan (JP)

(72) Inventor: Souichi Tsuruta, Hekinan (JP)

( * ) Notice: Subject to any disclaimer, the term of this patent is extended or adjusted under 35 U.S.C. 154(b) by 0 days.

(21) Appl. No.: 15/754,180

(22) PCT Filed: Aug. 9, 2016

(86) PCT No.: PCT/JP2016/073382

§ 371 (c)(1),
(2) Date: Feb. 21, 2018

(87) PCT Pub. No.: WO2017/033733

PCT Pub. Date: Mar. 2, 2017

(65) Prior Publication Data

US 2018/0254023 A1 Sep. 6, 2018

(30) Foreign Application Priority Data

Aug. 24, 2015 (JP) ..... 2015-164756

(51) Int. Cl.

| | |
|---|---|
| ***G10D 1/02*** | (2006.01) |
| ***G10D 3/12*** | (2006.01) |
| ***G10D 3/04*** | (2006.01) |
| ***G10D 3/06*** | (2006.01) |
| ***G10D 3/10*** | (2006.01) |

(52) U.S. Cl.

CPC ..... *G10D 1/02* (2013.01); *G10D 3/04* (2013.01); *G10D 3/06* (2013.01); *G10D 3/10* (2013.01); *G10D 3/12* (2013.01)

(58) Field of Classification Search

CPC .. G10D 1/02; G10D 3/04; G10D 3/06; G10D 3/10; G10D 3/12

See application file for complete search history.

(56) References Cited

U.S. PATENT DOCUMENTS

| | | | | |
|---|---|---|---|---|
| 1,337,793 A * | 4/1920 | Poehland | ..... | G10D 3/12 84/302 |
| 1,760,343 A * | 5/1930 | Callier | ..... | G10D 3/12 84/302 |
| 1,791,977 A * | 2/1931 | Seckendorf | ..... | G10D 3/12 84/302 |

(Continued)

FOREIGN PATENT DOCUMENTS

| | | |
|---|---|---|
| JP | H05-273963 A | 10/1993 |
| JP | 2000259149 A | 9/2000 |
| JP | 2015075702 A | 4/2015 |

*Primary Examiner* — Robert W Horn

(74) *Attorney, Agent, or Firm* — Shay Glenn LLP

(57) ABSTRACT

[Problems to be Solved]

The object of the present invention is to provide a stringed instrument which can maintain sound volume at a specific level, optimize vibration of strings and resonance of body and improve balance of the sound volume and sound quality in the treble side tone and the bass side tone.

[Means for Solving the Problems]

A force is applied to a front end of said tailpiece for rotating a front end of a tailpiece in a direction from a portion to which a string having a high basic frequency is fastened to a portion to which a string having a low basic frequency is fastened so that a load applied from the string having a high basic frequency to a bridge decreases and a load applied from the string having a low basic frequency to the bridge increases.

5 Claims, 14 Drawing Sheets

(56) References Cited

U.S. PATENT DOCUMENTS

| | | | | | |
|---|---|---|---|---|---|
| 1,884,434 | A * | 10/1932 | Wehmann | G10D 3/12 | 84/302 |
| 2,743,643 | A * | 5/1956 | Bramson | G10D 3/12 | 84/302 |
| 2,971,422 | A * | 2/1961 | Passa | G10D 3/12 | 84/302 |
| 3,096,676 | A * | 7/1963 | Havivi | G10D 3/12 | 84/302 |
| 3,688,630 | A * | 9/1972 | Tartaglia | G10D 3/12 | 84/302 |
| 4,224,857 | A * | 9/1980 | Infeld | G10D 3/12 | 84/207 |
| 4,238,986 | A * | 12/1980 | Twiford | G10D 3/04 | 84/274 |
| 4,334,455 | A * | 6/1982 | Beecher | G10D 3/12 | 84/297 R |
| 5,734,117 | A * | 3/1998 | Tanzella | G10D 3/04 | 84/298 |
| 6,635,812 | B2 * | 10/2003 | Roth | G10D 3/12 | 84/297 R |
| 2005/0217455 | A1 * | 10/2005 | Ricci | G10D 3/12 | 84/302 |
| 2017/0249928 | A1 * | 8/2017 | Kuo | G10D 3/12 | |
| 2018/0254023 | A1 * | 9/2018 | Tsuruta | G10D 1/02 | |

* cited by examiner

STRINGED INSTRUMENT

TECHNICAL FIELD

The present invention relates to a stringed instrument, and more particularly, to a stringed instrument which enables optimized vibration of strings and resonance of a body and improved balance of the sound volume and quality in both high tone sound and low tone sound while maintaining the sound volume.

BACKGROUND ART

As an example of the conventional stringed instrument having a tailpiece such as violin, viola, cello and contrabass, the basic structure of a violin will be described. As shown in FIG. 14, the violin 100 includes a hollow box-shaped body 110, neck 120 provided on a front end of the body 110, strings 130, tailpiece 140 to which ends of strings 130 are fastened, and bridge 150 for transmitting the vibration of the strings 130 to the body 110.

The body 110 includes an upper plate 112, lower plate 114 and side plate 116 for connecting the upper plate 112 and lower plate 114 so as to form a hollow resonance body.

The strings 130 may be individually tensioned on the upper plate of the body with predetermined intervals therebetween. Observed from the back end portion to the front end portion of the body, four strings, from the right to left, e-string 130*e*, a-string 130*e*, d-string 130*e* and g-string 130*e* are provided in this order. The basic frequency of the released e-string 130*e* is the highest and the basic frequency of the released strings decreases in the order of a-string 130*a*, d-string 130*e* and g-sting 130*g*. The front ends of the strings 130 are wound to the pegs 122 provided in the front end of the neck and the back ends of the strings are fastened to the tailpiece 140.

In the front end portion of the tailpiece 140, four string holes 142*e*, 142*a*, 142*d*, 142*g* are defined. The back ends of e-string 130*e*, a-string 130*a*, d-string 130*d* and g-string 130*g* are inserted in and fastened to the string holes 142*e*, 142*a*, 142*d*, 142*g*, respectively.

As shown in FIG. 15, in a backward portion of the tailpiece 140, two tail gut insertion holes 144 are formed. The ends of tail gut 150 are inserted in the tail gut insertion holes 144 from a back end direction. In the ends of tail guts 150 drawn forward through the tail gut insertion holes 144, a knot 152 is formed so that the tail gut 150 is fastened to the tailpiece 140. As shown in FIG. 14, a u-shaped portion of the tail gut 150 which protrudes from the back end of the tailpiece 140 is connected to an end pin 118 so that the tailpiece 140 is fastened to the body 110 and the strings 130 are provided on the upper plate 112 of the body 110 with specific string tensions.

On the surface of the upper plate 112 of the body 110, a bridge 150 is positioned between the neck 120 and the tailpiece 140 for supporting the four strings 130 and transmitting the vibration of the strings 130 to the body 110. The load applied to the bridge 150 from the e-string is the largest and the loads applied to the bridge 150 from the strings decreases in the order of a-string 130*a*, d-string 130*d* and g-string 130*g*.

The violin having the above structure generates tones by the vibration of the four strings when drawn by a bow or plucked by fingers, and resonance of the body is caused by the vibration transmitted to the body 110 via the bridge

PRIOR ART REFERENCE

Patent Document

[Patent Document 1] Japanese Patent Application Publication No. H05-273963

[Patent Document 2] Japanese Patent Application Publication No. 2000-259149

[Patent Document 3] Japanese Patent Application Publication No. 2015-75702

SUMMARY OF INVENTION

Problems to be Solved by the Invention

Concert halls for the stringed instruments such as violin have become larger when comparing private halls in the middle age to modern concert halls. For this reason, there is a need for the volume of stringed instruments to be increased. Thus, the string tension in modern violins is higher than that of the conventional baroque violins.

However, when the string tension is excessively high, the load applied to the bridge 150 from the strings 130 and the load applied to the body 110 from the bridge 150 excessively increase. In such a case, the strings cannot vibrate in a proper form and the vibration of the surface of the body 110 decreases, which deteriorates the sound quality. This phenomenon is apparent especially in the treble string side (i.e., e-string 130*e* and a-string 130*a*).

On the other hand, when the string tension is excessively low, the volume of the stringed instrument becomes low, which makes the stringed instrument unsuitable in the large-scale concert halls. Also, it makes it difficult to transmit the vibration of the strings 130 to the body 110 through the bridge 150, which makes it difficult to generate the resonance of the body 110. This phenomenon is apparent especially in the bass string side (i.e., d-string 130*d* and g-string 130*g*).

The present invention aims to solve the above problems. The object of the present invention is to provide a stringed instrument which can maintain the volume at a specific level by maintaining string tension at a specific level, optimize the vibration of strings and the resonance of the body and improve the balance of the sound volume and sound quality in the treble side and the bass side.

Means for Solving the Problems

In order to achieve the above object, the a stringed instrument according to the present invention comprises, a hollow box-shaped body having a front end and a back end, a neck provided in the front end of said body, said neck having a front end and a back end, a tailpiece provided in the back end of said body, said tailpiece having a front end and a back end, a plurality of strings, one end of each string being fastened to the front end of the neck and the other end of each string being fastened to the front end of the tailpiece, said strings being provided at specific string tensions at predetermined intervals between the front end of the neck and the front end of the tailpiece, and a bridge positioned on the body between the neck and the tailpiece for supporting said strings and transmitting vibration of said strings to said body, wherein each released string has a different basic frequency, and the strings are arranged on said neck and said body in the order of the basic frequency, and wherein a force is applied to the front end of said tailpiece for rotating the front end of said tailpiece to which said strings are fastened in a direction from a portion to which the string having a high basic frequency is fastened to a portion to which the string having a low basic frequency is fastened so that a load applied from the string having a high basic frequency to said bridge decreases and a load applied from the string having a low basic frequency to said bridge increases.

Effects of the Invention

According to the stringed instrument of the present invention, a force is applied for rotating the front end of the tailpiece to which a plurality of strings are fastened in a direction from a portion to which the string having a high basic frequency is fastened to a portion to which the string having a low basic frequency is fastened. Thus, a load applied from the string having a high basic frequency to the bridge decreases and a load applied from the string having a low basic frequency to the bridge increases. Therefore, the sound quality of the treble string having a high basic frequency can be improved and the vibration of the strings can be effectively transmitted to the body without decreasing the entire sound volume of the strings. In addition, the vibration of the bass strings having a low basic frequency can be effectively transmitted to the body.

MODE FOR CARRYING OUT THE INVENTION

Hereinafter, embodiments of the present invention will be described with reference to the drawings.

Figure 1:
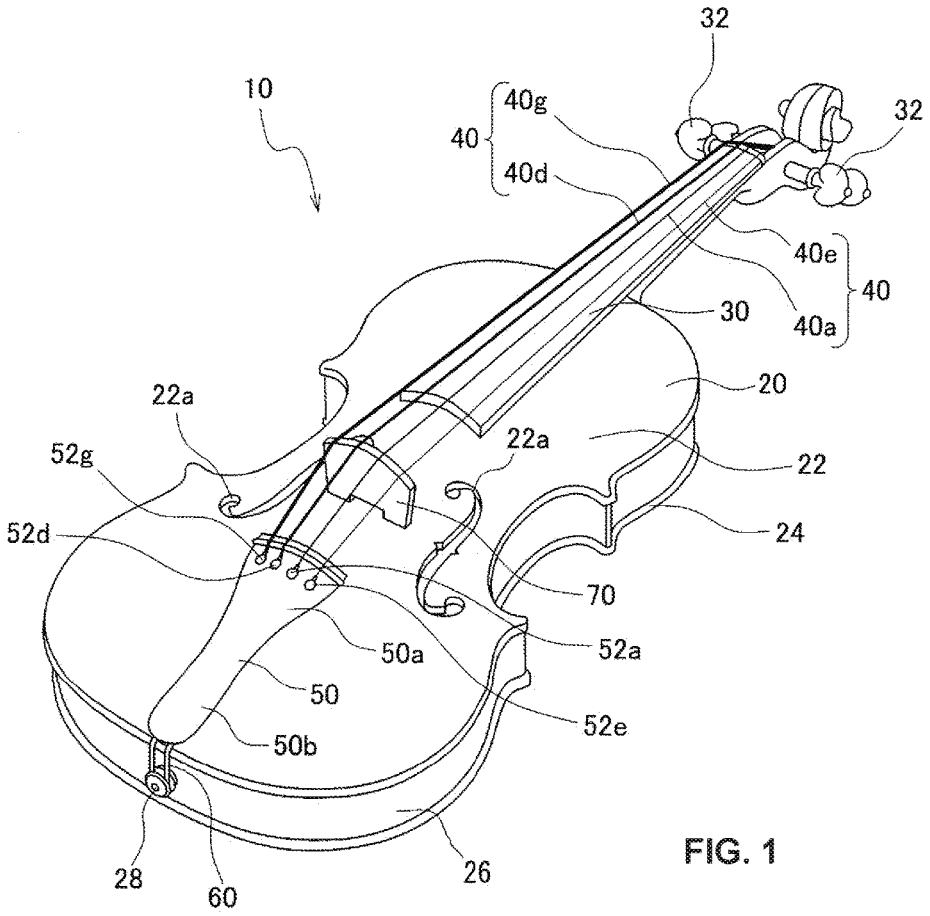
FIG. 1 is a perspective view showing a violin in accordance with the present invention.
Figure 2:
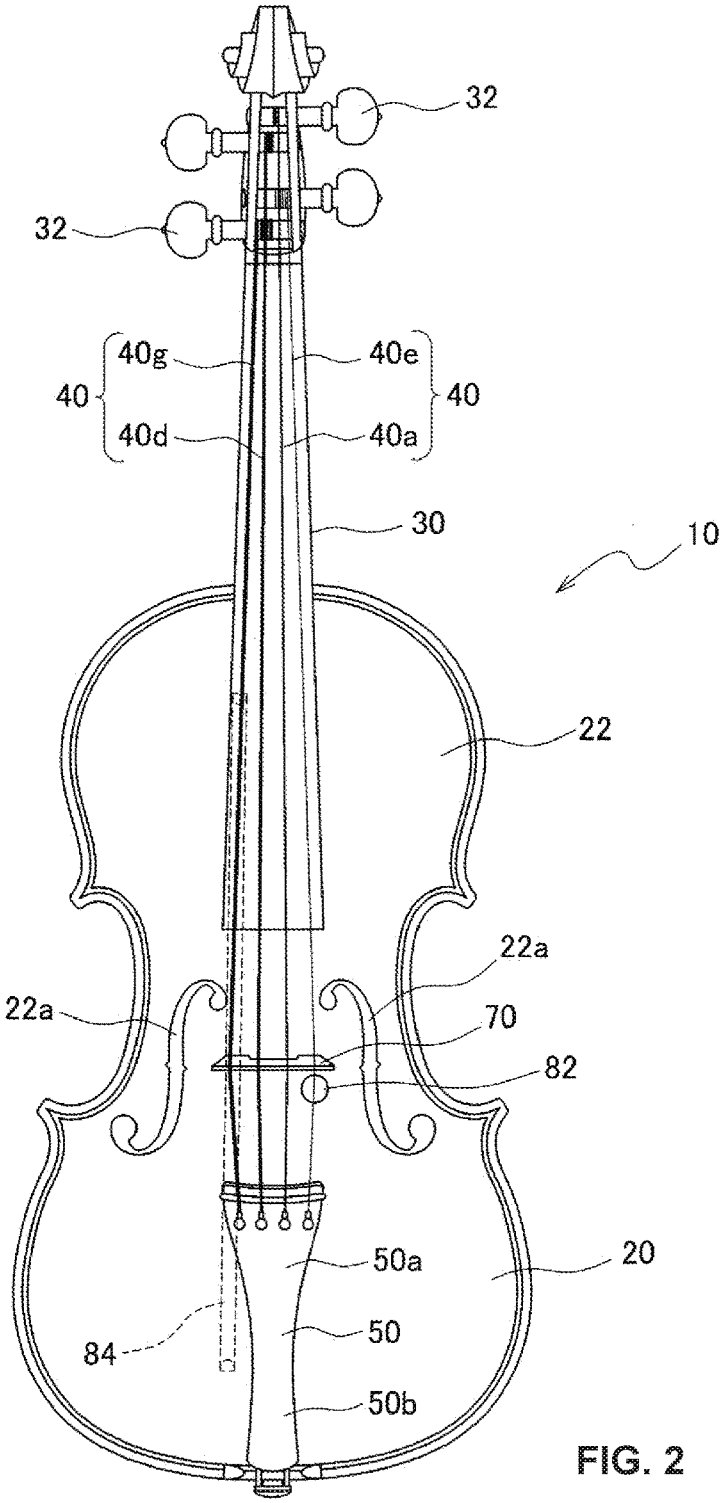
FIG. 2 is a plan view showing a violin in accordance with the present invention.

FIGS. 1 and 2 show a violin of the present invention. As shown in FIGS. 1 and 2, the violin 10 comprises a body 20 having a hollow box structure, neck 30 provided on a front end of the body 20, strings 40 provided on the surface of the body 20 and neck 30 with predetermined string tensions, tailpiece 50 to which ends of the strings 40 are fastened, tail gut 60 for fastening the tailpiece 50 to the body 20 and bride 70 for transmitting the vibration of the strings to the body.

The body 20 comprises an upper plate 22 in which f-shaped holes 22*a* are formed, lower plate 24 arranged in parallel with respect to the upper plate 22 and side plate 26 for connecting the upper plate 22 and the lower plate 24. The body 20, as a whole, forms a Helmholts resonator. The body 20 can be made of wood material such as spruce and maple, plastic and so on.

With regard to strings 40, observed from the back end to the front end of the body, e-string 40*e*, a-string 40*a*, d-string 40*d* and g-string 40*g* are provided from right to left in this order at predetermined intervals. The released e-string 40*e* has the highest basic frequency and the basic frequency of the released a-string, d-string and g-string decreases in this order so that the basic frequency of the strings 40 decreases from right to left. The front end of the each string 40 is wound in pegs 32 provided in the front end of the neck 30. The back end of the each string 40 is fastened to the tailpiece 50 provided adjacent to the back end of the upper plate 22 of the body 20.

Figure 3:
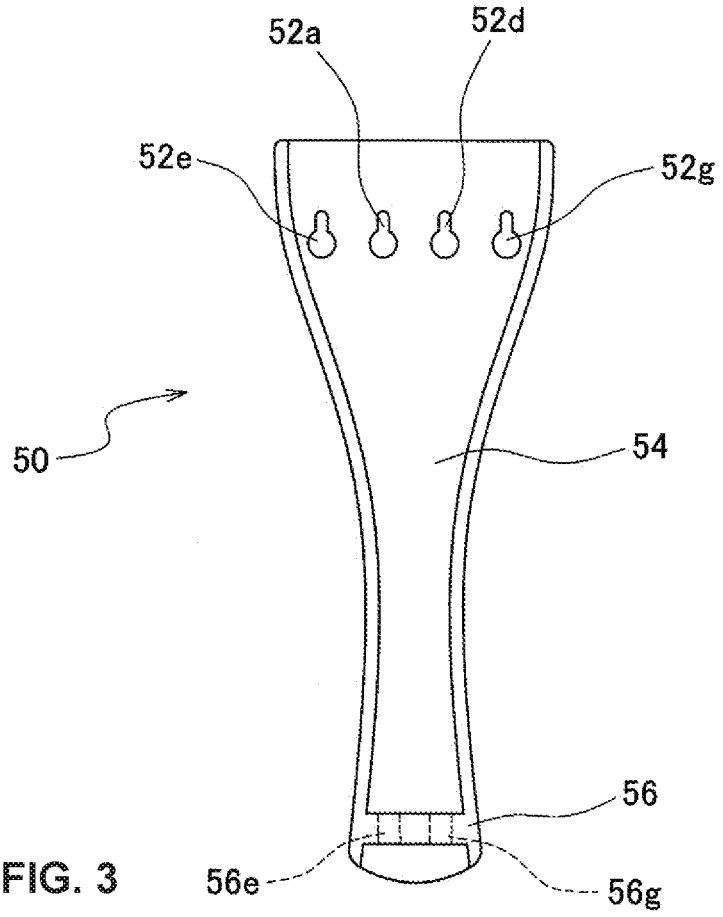
FIG. 3 is a backside view of a tailpiece.

The tailpiece 50 includes a front portion 50*a* of a trapezoid plane shape whose width gradually reduces from the front end and a back portion 50*b* of a rectangular plane shape continuously formed from the front portion 50*a*. The surface of the tailpiece 50 has an arch shape in its cross-section in which a central portion thereof in its longitudinal direction projects. As shown in FIG. 3, a recess portion 54 is formed in a backside of the tailpiece 50. The tailpiece 50 can be integrally made of woods such as boxwood and ebony, plastic, metal material and so on.

In the front portion 50*a* of the tailpiece, four string fastening holes 52*e*, 52*a*, 52*d*, 52*g* are formed. The back end of the e-string 40*e*, a-string 40*a*, d-string 40*d* and g-string 40*g* are fastened to the string fastening holes 52*e*, 52*a*, 52*d*, 52*g*, respectively. In a backward portion of the recess portion 54 of the backside of the tailpiece 50, a vertical wall 56 is formed. In the vertical wall 56, along a width direction of the tailpiece, an e-string side tail gut insertion hole 56*e* located in the string fastening hole 52*e* side and g-string side tail gut insertion hole 56*g* located in the string fastening hole 52*g* side are symmetrically formed. Both ends of the tail gut 60 are inserted and fastened to the tail gut insertion holes 56*e*, 56*g*.

The tail gut 60 is a gut member having a diameter of 0.5-2.5 mm. As a tail gut 60, material having a high mechanical strength and low elongation percentage can be used, such as nylon fiber, polyacrylate fiber, polyethylene fiber, poly-paraphenylene terephthalamide fiber, and natural gut strings manufactured from sheep or bovine (cow) guts and so on. A u-shape portion of the tail gut 60, which protrudes backward from the tail gut holes 56*e*, 56*g* of the tailpiece 50 is fastened to an end pin 28 provided in the back end of the body 20. By the above structure, the strings 40 are provided with specific string tensions on the surface of the upper plate 22 of the body 20 and the neck 30.

On the surface of the upper plate 22 of the body 20, a bridge 70 is positioned between the neck 30 and tailpiece 50 for supporting the strings 40 and transmitting the vibration of strings 40 to the body. The bridge 70 can be made of wood such as maple having a thickness of approximately 1-5 mm.

Figure 4:
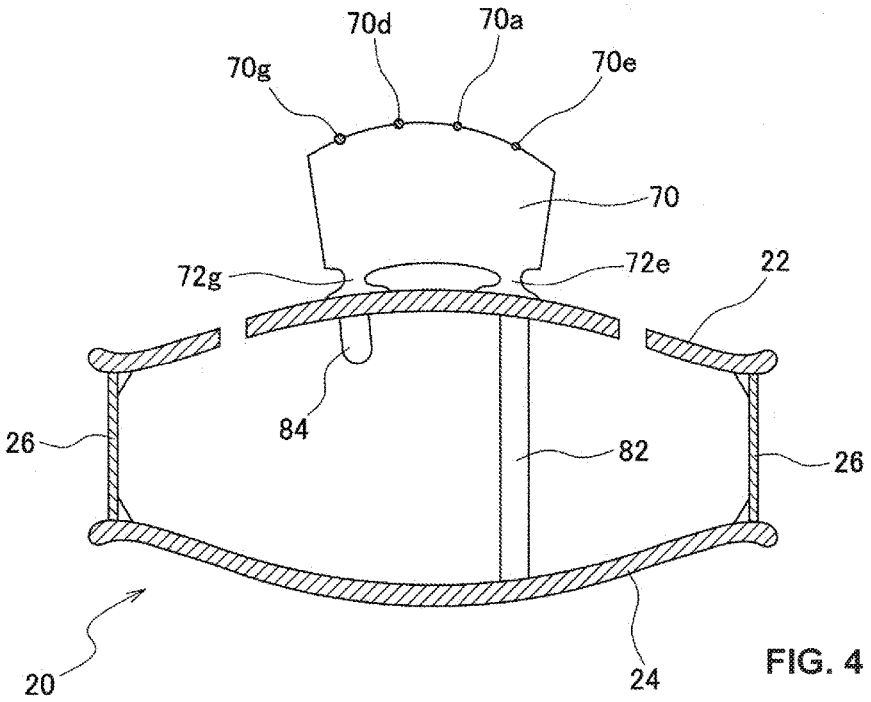
FIG. 4 is a vertical cross-sectional view showing a violin in accordance with the present invention.

As shown in FIG. 4, the bridge 70 has an upper portion having an arc shape. In the upper portion of the bridge 70, there are formed four notches 70*e*, 70*a*, 70*d*, 70*g* respectively receiving and supporting the e-string 40*e*, a-string 40*a*, d-string 40*d*, g-string 40*g*. In a lower end portion of the bridge 70, there are formed an e-string side leg 72*e* of the notch 70*e* side and an g-string side leg 72*g* of the notch 70*g* side for standing the bridge 70 on the upper plate 22 of the body 20. The vibration of the strings 40 supported on the upper end of the bridge 70 is transmitted to the body 20 through the legs 72*e*, 72*d*.

As shown in FIG. 4, inside the body 20, in a portion of the back side of the upper plate 22 corresponding to the e-string side leg 72*e*, a sound post 82 is provided so as to connect the upper plate 22 and lower plate 24 for transmitting the vibration of treble strings (mainly, e-string) to the lower plate 24 and properly vibrating both the upper plate 22 and lower plate 24. In a portion of the back side of the upper plate 22 corresponding to the g-string side leg 72*g*, a bass bar is provided along the g-string for reinforcing the upper plate 22 against the string tensions of bass strings (mainly, g-string) and strengthening and stabilizing bass tones. Among loads applied from each string 40 to the bridge 70, the load of e-string 40*e* is the highest. Then, the loads of each string 40 to the bridge decreases in the order of a-string 40*a*, d-string 40*d* and g-string 40*g*.

Next, methods for fastening the tail gut 60 to the tailpiece 50 will be described, referring to FIGS. 5-12.

Figure 5:
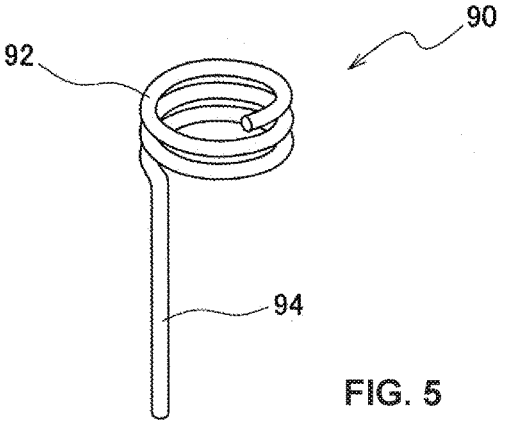
FIG. 5 is a perspective view showing a fastening jig.

FIG. 5 shows a fastening jig 90 for fastening the tail gut 60 to the tailpiece 50. The fastening jig 90 is made of one metal wire having a specific stiffness and includes a ring portion 92 in which the wire is wound and a linear insertion portion 94 linearly extending from one end of the ring portion 92. The outer diameter of the ring portion 92 is smaller than the width of the vertical wall 56 of the tailpiece 50 and a little bit larger than the diameter of the tail gut insertion holes 56*e*, 56*g*. The inner diameter of the ring portion 92 is formed so that two tail guts can be inserted.

Figure 6:
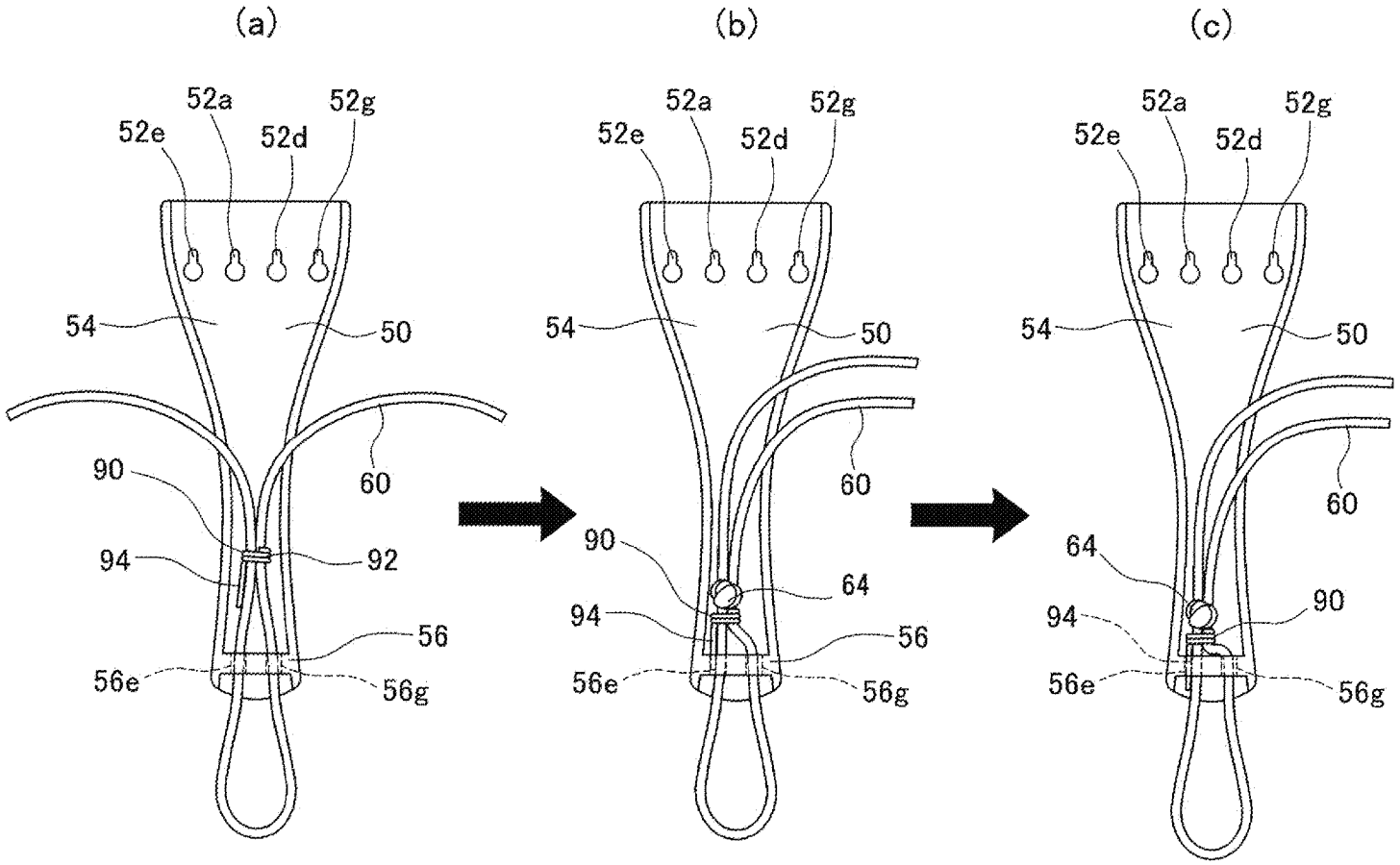
FIG. 6 is a backside view of a tailpiece for explaining a method for fastening a tail gut to a tailpiece.

The first example for fastening the tail gut 60 to the tailpiece 50 using the fastening jig 90 will be described, referring to FIGS. 6-8. First, as shown in FIG. 6 (*a*), both ends of the tail gut 60 are inserted into the recess portion 54 of the tailpiece 50 through the tail gut insertion holes 56*e*, 56*g* in the back side of the tailpiece 50. The inserted both ends of the tail gut 60 are inserted in the ring portion 92 of the fastening jig 90 arranged in a manner that the linear portion 94 points to the vertical wall 56.

Then, the both ends of the tail gut 60 are tied to form a knot 64. The knot 64 is larger than the inner diameter of the ring portion 92.

Under the above condition, as shown in FIG. 6 (*b*), the insertion portion 94 of the fastening jig 90 is inserted to the e-string side tail gut insertion hole 56*e* with the tail gut. As a result, as shown in FIG. 6 (*c*), the knot 64 of the tail gut 60 is positioned closer to the e-string side tail gut insertion hole 56*e* than a middle point of the tail gut insertion holes 56*e*, 65*g*. The tail gut inserted in the e-string side tail gut insertion hole 56*e* with the linear portion 94 of the fastening jig 90 linearly extends from the knot 64 along a longitudinal direction of the tailpiece. The other tail gut extends along a width direction of the vertical wall 56, contacts a periphery portion of the g-string side tail gut insertion hole 56*g*, and then inserted in g-string side tail gut insertion hole 56*g*.

Next, the function of the tailpiece 50 will be described. As shown in FIG. 7, when a force towards the back end portion of the violin (arrow A direction) is applied to the u-shaped portion of the tail gut 60, a force of clockwise direction (arrow B direction) is applied to the vertical wall 56 of the tailpiece 50 by the tail gut contacting the periphery portion of the g-string side tail gut insertion hole 56*g*. As a result, a force for rotating the front end portion of the tailpiece from the string fastening hole 52*e* to the string fastening hole 52*g* (arrow C direction) is applied to the tailpiece.

Figure 8:
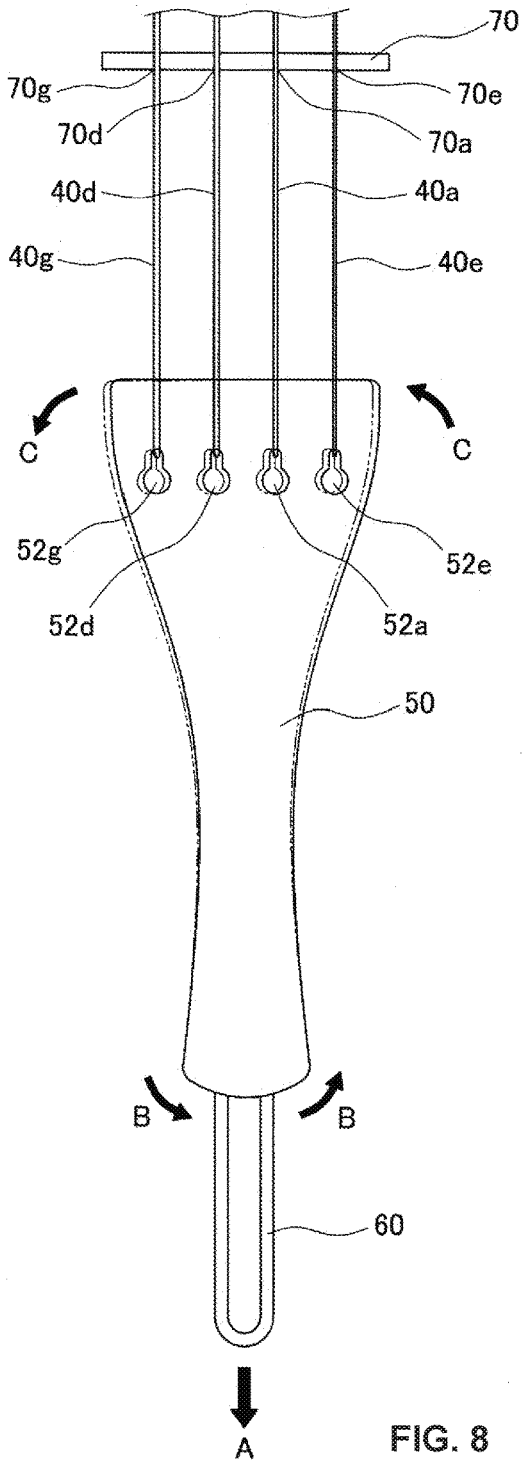
FIG. 8 is a plan view showing a tailpiece, gut and bridge for explaining a function of the present invention.

Observed from the surface of the violin and the tailpiece, as shown in FIG. 8, when the u-shaped portion of the tail gut 60 is connected to the end pin 28 of the body 20, a force of arrow A direction is applied to the u-shaped portion of the tail gut 60 and a force is applied to the front end of the tailpiece 50 so as to rotate the front end portion from the e-string 40*e* to the g-string 40*g* direction. Thus, the load applied to the bridge 70 from the treble strings (e-string 40*e* and a-string 40*a*) decreases and the load applied to the bridge 70 from the bass strings (d-string 40*e* and g-string 40*a*) increases. As a result, the load applied to the body 20 from the e-string side leg 72*e* decreases and the load applied to the body 20 from the g-string side leg 72*g* increases.

Figure 9:
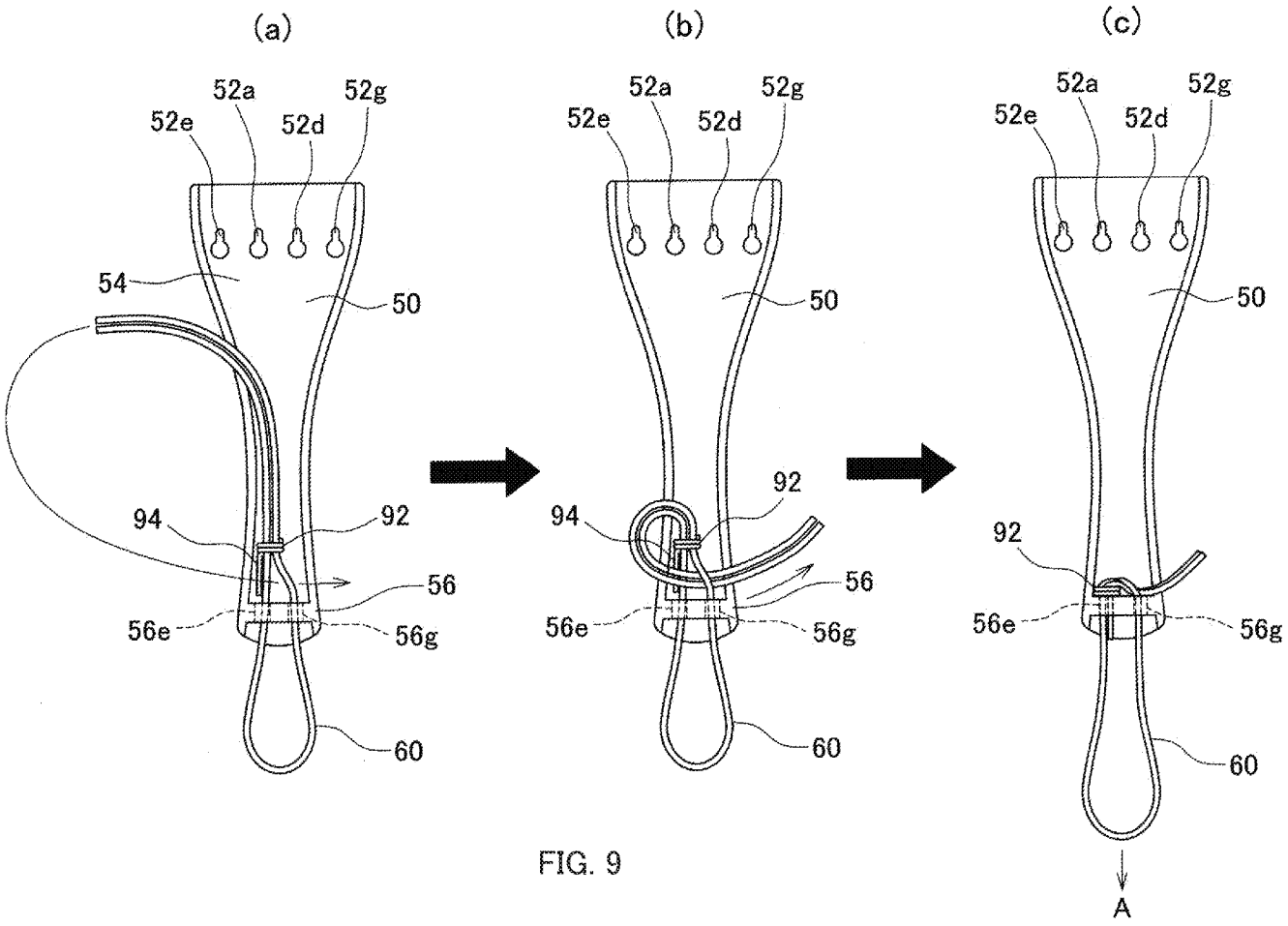
FIG. 9 is a backside view showing a tailpiece for explaining the other method for fastening a tail gut to a tailpiece.

Next, the second example for fastening the tail gut 60 to the tailpiece 50 will be described, referring to FIGS. 9-10. First, as shown in FIG. 9 (*a*), both ends of the tail gut 60 are inserted into the recess portion 54 of the tailpiece 50 through the tail gut insertion holes 56*e*, 56*g* in the back side of the tailpiece 50. The inserted both ends of the tail gut 60 are inserted in the ring portion 92 of the fastening jig 90 arranged in a manner that the linear insertion portion 94 points to the vertical wall 56.

Next, as shown in FIG. 9 (*b*), both ends of the tail gut 60 are made to pass under the tail gut inserted through the tail gut insertion hole 56*g*. Then, the linear portion 94 of the fastening jig 90 is inserted to the e-string side tail gut insertion hole 56*e* with the tail gut. As a result, as shown in FIG. 9 (*c*), the ring portion 92 of the fastening jig 90 is positioned closer to the e-string side tail gut insertion hole 56*e*. The tail gut inserted in the e-string side tail gut insertion hole 56*e* with the linear portion 94 of the fastening jig 90 linearly extends from the ring portion 92 of the fastening jig 90 along a longitudinal direction of the tailpiece. The other tail gut extends along a width direction of the vertical wall 56 from the ring portion 92 of the fastening jig 90, contacts a periphery portion of the g-string side tail gut insertion hole 56*g*, and then inserted in g-string side tail gut insertion hole 56*g*.

Figure 10:
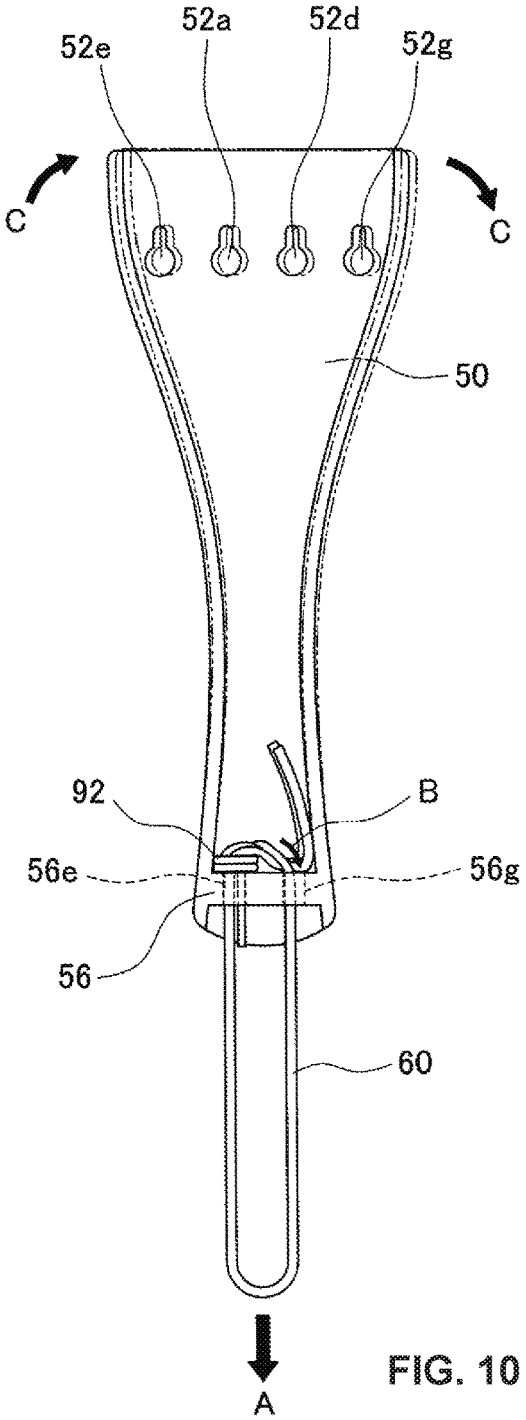
FIG. 10 is a backside view showing a tailpiece for explaining a function of the present invention.

As shown in FIG. 10, when a force towards the lower end portion of the violin (arrow A direction) is applied to the u-shaped portion of the tail gut 60 fastened to the tailpiece in the above manner, a force of clockwise direction (arrow B direction) is applied to the vertical wall 56 of the tailpiece 50 by the tail gut contacting the periphery portion of the g-string side tail gut insertion hole 56*g*. As a result, a force for rotating the front end portion of the tailpiece in a direction from the string fastening hole 52*e* to the string fastening hole 52*g* (arrow C direction) is applied to the tailpiece.

Figure 11:
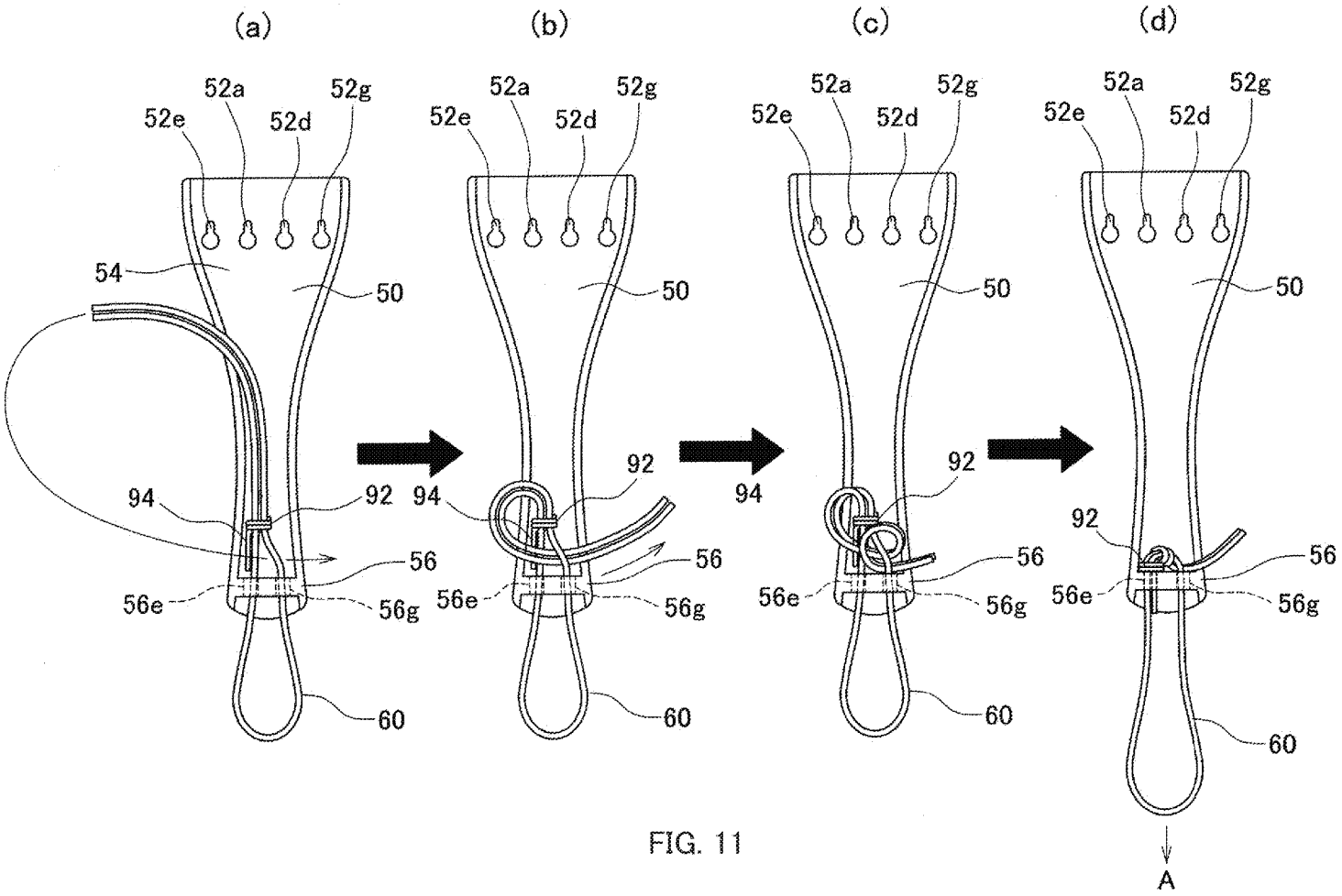
FIG. 11 is a backside view showing a tailpiece for explaining the other method for fastening a tail gut to a tailpiece.

Next, the third example for fastening the tail gut 60 to the tailpiece 50 will be described, referring to FIGS. 11-12. First, as shown in FIG. 11 (*a*), both ends of the tail gut 60 are inserted into the recess portion 54 of the tailpiece 50 through the tail gut insertion holes 56*e*, 56*g* in the back side of the tail gut 60. The inserted both ends of the tail gut 60 are inserted in the ring portion 92 of the fastening jig 90 arranged in a manner that the linear insertion portion 94 points to the vertical wall 56.

Next, as shown in FIG. 11 (*b*), both ends of the tail gut 60 are made to pass under the tail gut inserted through the tail gut insertion hole 56*g*. Then, as shown in FIG. 11 (*c*), the ends of the tail gut 60 which passed under the tail gut 60 is wound around the tail gut 60 passed through the tail gut insertion hole 56*g*. After that, the linear portion 94 of the fastening jig 90 is inserted to the e-string side tail gut insertion hole 56*e* with the tail gut. As a result, as shown in FIG. 11 (*d*), the ring portion 92 of the fastening jig 90 is positioned closer to the e-string side tail gut insertion hole 56*e*. The tail gut 60 inserted in the e-string side tail gut insertion hole 56*e* with the linear portion 94 of the fastening jig 90 linearly extends from the ring portion 92 of the fastening jig 90 along a longitudinal direction of the tailpiece. The other tail gut extends along a width direction of the vertical wall 56 from the ring portion 92 of the fastening jig 90, contacts a periphery portion of the g-string side tail gut insertion hole 56*g*, and then inserted in g-string side tail gut insertion hole 56*g*.

Figure 12:
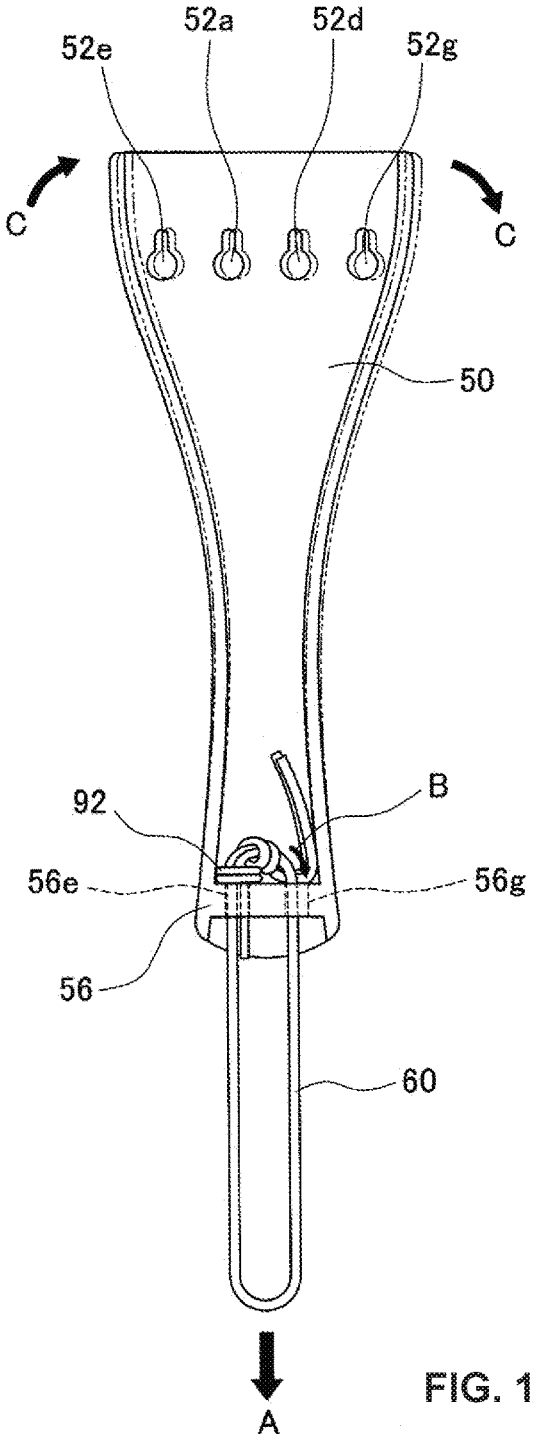
FIG. 12 is a backside view showing a tailpiece for explaining a function of the present invention.

As shown in FIG. 12, when a force towards the lower end portion of the violin (arrow A direction) is applied to the u-shaped portion of the tail gut 60 fastened to the tailpiece in the above manner, a force of clockwise direction (arrow B direction) is applied to the vertical wall 56 of the tailpiece 50 by the tail gut contacting the periphery portion of the g-string side tail gut insertion hole 56*g*. As a result, a force for rotating the front end portion of the tailpiece from the string fastening hole 52*e* to the string fastening hole 52*g* (arrow C direction) is applied to the tailpiece.

Hereinafter, the function of the violin according to the present invention will be described. The violin generates tones by the vibration of the four strings 40 when drawn by a bow or plucked by fingers and resonance of the body 20 is caused by the vibration transmitted from the strings 40 to the body 20 via the bridge 70. According to the violin 10 of the present invention, since the rotating force from the e-string side to the g-string side is applied to the front end of the tailpiece 50, the load applied to the treble strings side of the upper end of the bridge 70 and the e-string side leg 72*e* decreases and the load applied to the bass strings side of the upper end of the bridge 70 and the g-string side leg 72*g* increases. Thus, the sound quality of the treble strings (e-string and a-string), which have a higher strings tension, can be improved and the vibration of the treble strings can be effectively transmitted to the body 20. Also, the vibration of the bass strings (d-string and g-string), which have a lower string tension, can be effectively transmitted to the body 20.

EXAMPLES

Hereinafter, the present invention will be concretely described with reference to the Examples.

Example 1, Example 2 and Comparative Example 1

Figure 13:
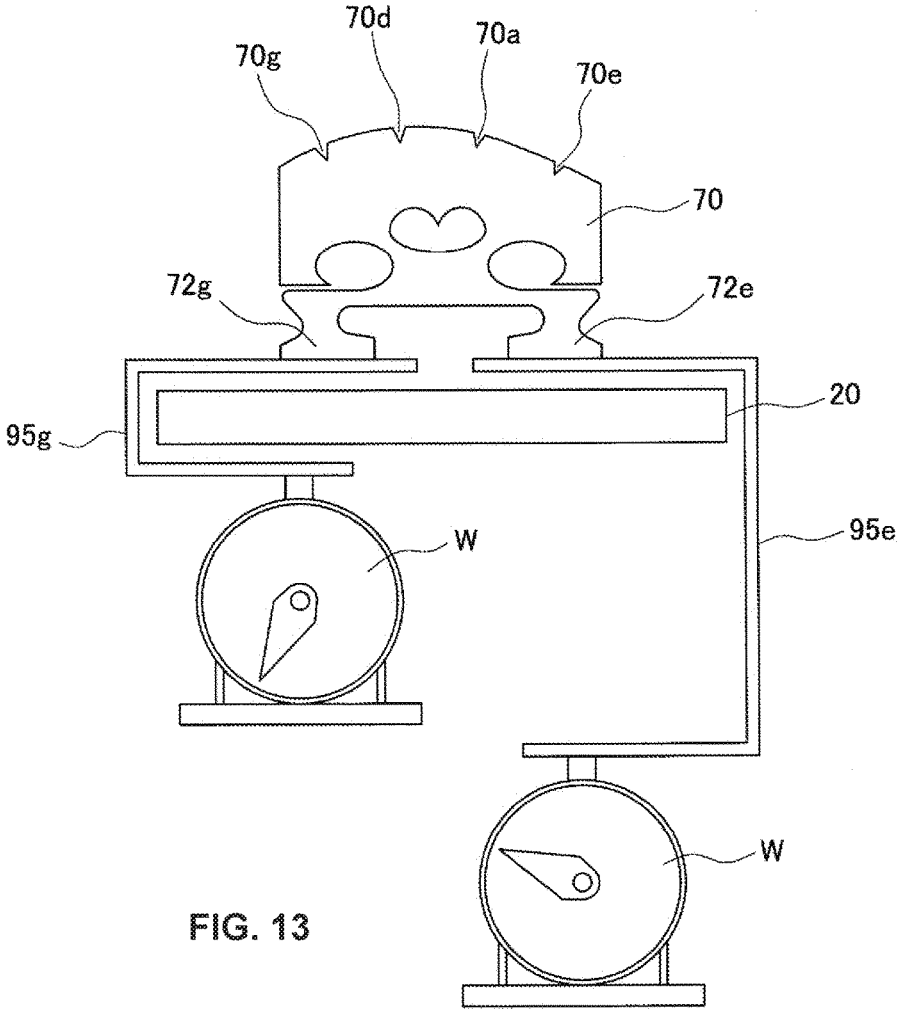
FIG. 13 is a view explaining a principle for measuring loads applied to legs of the bridge.
Figure 14:
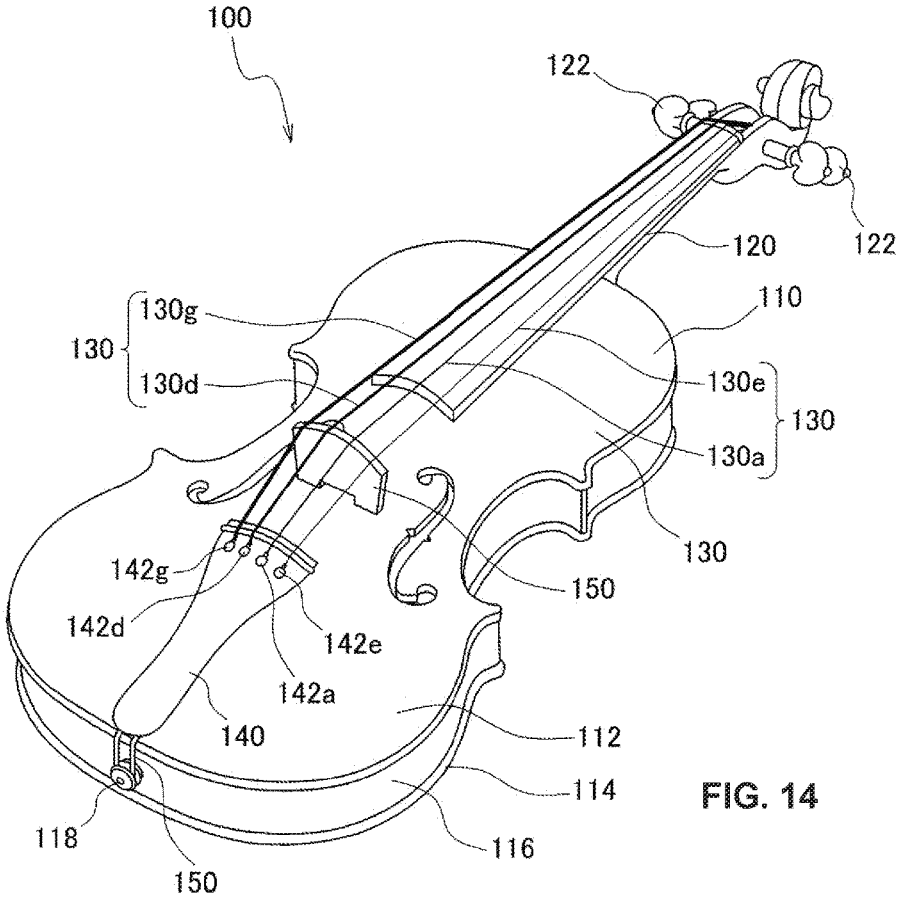
FIG. 14 is a perspective view showing the conventional violin.

In a violin in which strings were provided at certain string tensions, the loads applied to the e-string side leg 72*e* and g-string side leg 72*g* of the bridge 70 were measured. More specifically, as shown in FIG. 13, an electric violin having a plate-shape body was used. The legs 72*e*, 72*g* were connected to measuring tools 95*e*, 95*g* respectively and the measuring tools 95*e*, 95*g* was placed on weight measuring tools W. Five minutes after providing and tuning the strings, the loads applied to the e-string side leg 72*e* and g-string side leg 72*g* were measured. The tail guts were fastened to the tailpiece in manners described in FIGS. 7, 12 and 15. As a tailpiece, a metal tailpiece having a weight of 25 g was used. As a tail gut, a polyacrylate fiber having a diameter of 1.8 mm was used. The results are shown in TABLE 1.

TABLE 1

Figure 7:
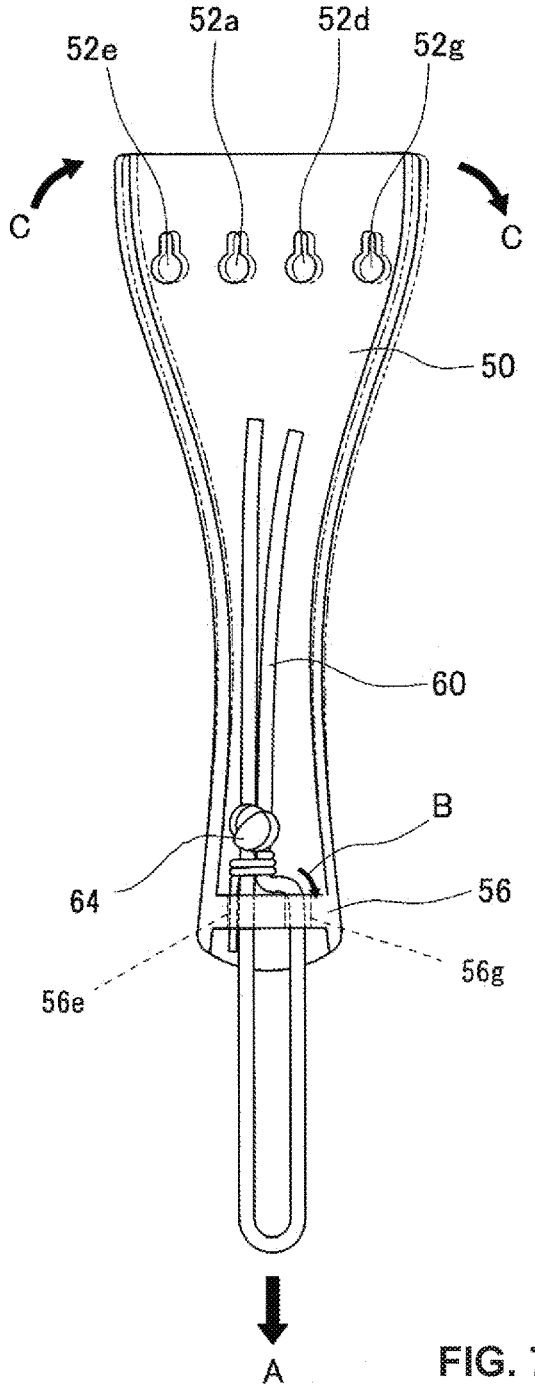
FIG. 7 is a backside view showing a tailpiece for explaining a function of the present invention.
Figure 15:
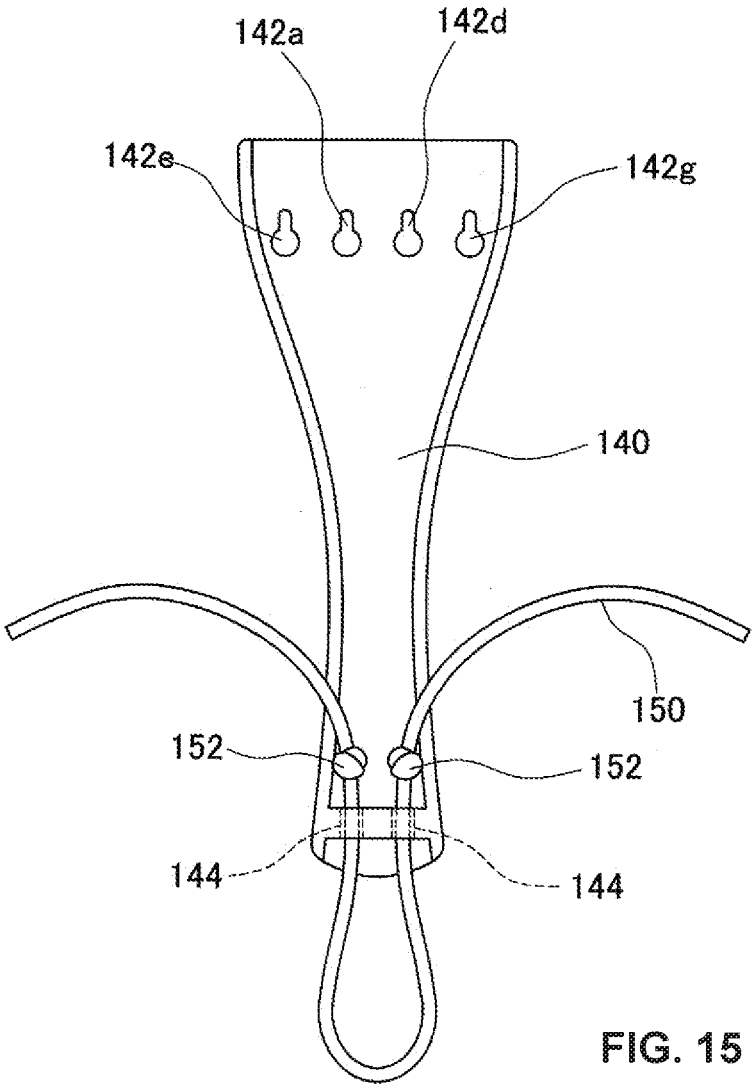
FIG. 15 is a backside view of the conventional violin.

| | Method for Fastening Tail Gut | Load Applied to E-String Side Leg (g) | Load Applied to G-String Side Leg (g) | Difference (g) |
|---|---|---|---|---|
| Example 1 | FIG. 7 | 4110 | 3659 | 451 |
| Example 2 | FIG. 12 | 4373 | 3597 | 776 |
| Comparative Example 1 | FIG. 15 | 4885 | 2945 | 1940 |

Example 3 and Comparative Example 2

The loads applied to the e-string side leg 72*e* and g-string side leg 72*g* of the bridge 70 were measured in a similar manner described with reference to Example 1 except that the tail guts were fastened to the tailpiece in manners described in FIGS. 12 and 15 and a polyethylene fiber having a diameter of 1.1 mm was used as the tail guts. The results are shown in TABLE 2.

TABLE 2

| | Method for Fastening Tail Gut | Load Applied to E-String Side Leg (g) | Load Applied to G-String Side Leg (g) | Difference (g) |
|---|---|---|---|---|
| Example 3 | FIG. 12 | 4500 | 3599 | 901 |
| Comparative Example 2 | FIG. 15 | 4585 | 3275 | 1310 |

As is apparent from TABLES 1 and 2, according to the Examples, the load applied to the e-strings side leg of the bridge decreased and the load applied to the g-strings side leg of the bridge increased, compared with the Comparative Examples. In addition, according to the Examples, the difference between the load applied to the e-strings side leg and the load applied to the g-strings side leg decreased, compared with Comparative Examples.

The present invention is not limited to the above embodiments and examples and the embodiments and examples can be changed without departing from the spirit and the scope of the invention. For example, though the above embodiments and examples are directed to the violin, the present invention can be carried out in other string instruments having the tailpiece and bridge, such as viola, cello and contrabass.

INDUSTRIAL APPLICABILITY

According to the present invention, there is provided a stringed instrument which can maintain sound volume at a certain level and optimize the balance of sound volume and sound quality both in the treble tone and bass tone.

The invention claimed is:

1. A stringed instrument comprising, a hollow box-shaped body having a front end and a back end, a neck provided in the front end of said body, said neck having a front end and a back end, a tailpiece provided in the back end of said body, said tailpiece having a front end and a back end, a plurality of strings, one end of each string being fastened to the front end of the neck and the other end of each string being fastened to the front end of the tailpiece, said strings being provided at specific string tensions at predetermined intervals between the front end of the neck and the front end of the tailpiece, and a bridge positioned on the body between the neck and the tailpiece for supporting said strings and transmitting vibration of said strings to said body, wherein each released string has a different basic frequency, and the strings are arranged on said neck and said body in the order of the basic frequency, and wherein a force is applied to the front end of said tailpiece for rotating the front end of said tailpiece to which said strings are fastened in a direction from a portion to which the string having a high basic frequency is fastened to a portion to which the string having a low basic frequency is fastened so that a load applied from the string having a high basic frequency to said bridge decreases and a load applied from the string having a low basic frequency to said bridge increases.

2. The stringed instrument according to claim 1, wherein the back end of said tailpiece is fastened to the back end of said body by a tail gut and said force applied to the front end of said tailpiece is applied by said tail gut.

3. The stringed instrument according to claim 2, wherein a vertical wall is formed in said back end of said tailpiece along a width direction of said tailpiece, two tail gut insertion holes are formed in said vertical wall symmetrically in the width direction of said tailpiece, both ends of said tail gut inserted through the tail gut insertion holes are formed to a knot, one tail gut inserted in one of the tail gut insertion holes formed in a low frequency string side extends from said knot along said vertical wall and contact an opening end of said tail gut insertion hole.

4. The stringed instrument according to claim 3, further comprising, a fastening jig made of a wire having a specific stiffness, said fastening jig having a ring portion in which said wire is wound and an insertion portion linearly extending from one end of said ring portion, said knot is in one side of the ring portion opposing to said insertion portion and said insertion portion is inserted in said tailpiece insertion hole formed in a high frequency string side.

5. A fastening jig for fastening a tail gut to a tailpiece in a stringed instrument, a fastening jig being made of a wire having a specific stiffness, said fastening jig having a ring portion in which said wire is wound and an insertion portion extending from one end of said ring portion.

* * * * *